US006053243A

United States Patent [19]

Kato et al.

[11] Patent Number: 6,053,243

[45] Date of Patent: Apr. 25, 2000

[54] HEADER PIPE FOR HEAT EXCHANGER AND MANUFACTURING APPARATUS AND MANUFACTURING METHOD THEREOF

[75] Inventors: Soichi Kato; Takashi Sugita; Hitoshi Makabe, all of Konan, Japan

[73] Assignee: Zexel Corporation, Tokyo, Japan

[21] Appl. No.: 08/931,713

[22] Filed: Sep. 16, 1997

[30] Foreign Application Priority Data

Jul. 17, 1996 [JP] Japan ..... 8-266737

[51] Int. Cl.[7] ..... F28F 9/02

[52] U.S. Cl. ..... 165/175; 165/153; 165/173

[58] Field of Search ..... 165/173, 174, 165/175, 153; 29/890.052, 890.053

[56] References Cited

U.S. PATENT DOCUMENTS

| | | | |
|---|---|---|---|
| 4,945,635 | 8/1990 | Nobuse et al. | 165/173 X |
| 5,243,842 | 9/1993 | Kobayashi et al. | 29/890.052 X |
| 5,341,872 | 8/1994 | Mercurio | 165/173 |
| 5,351,397 | 10/1994 | Angeli | 29/890.053 |
| 5,388,329 | 2/1995 | Randlett et al. | 29/890.053 X |
| 5,535,819 | 7/1996 | Matsuura | 165/153 X |
| 5,697,433 | 12/1997 | Kato | 165/153 X |

*Primary Examiner*—Leonard Leo
*Attorney, Agent, or Firm*—Wenderoth, Lind & Ponack, L.L.P.

[57] ABSTRACT

When forming a circular tube-shaped header pipe by rolling a plate material, surfaces extending at a right angle to the internal and external surfaces of the plate material are formed at the two side edges extending in the lengthwise direction, and the plate material is rolled in such a manner that the two side edges face opposite each other while setting the two side edges in a non-contact state. In this process, the gap between the two side edges is set at or less than 0.3 mm. In order to manufacture this header pipe, a plate material that has been cut to a specific length is trimmed in the direction of its short side to achieve a specific dimension and also at a right angle to the front and rear surfaces of the plate material. After a piping insertion hole is formed, the entirety of the plate material is rolled so that its cross section achieves a U-shape. A plurality of tube insertion holes are formed in this state and then, with only an upper die and a lower die, the two side edges of the plate material are rolled in a circular tube shape so that they face opposite each other. Any level misalignment between the side edge portions that face opposite each other can be prevented, and defective brazing is eliminated.

14 Claims, 11 Drawing Sheets

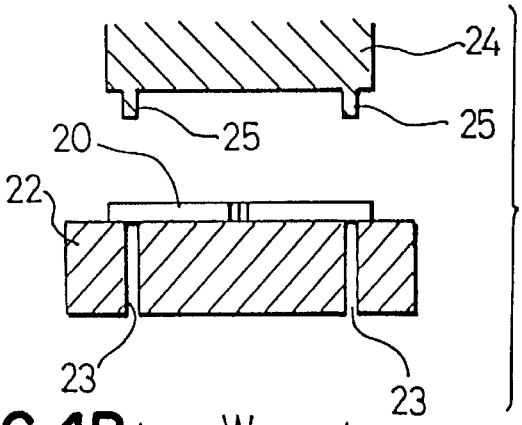
FIG. 4A
FIG. 4B
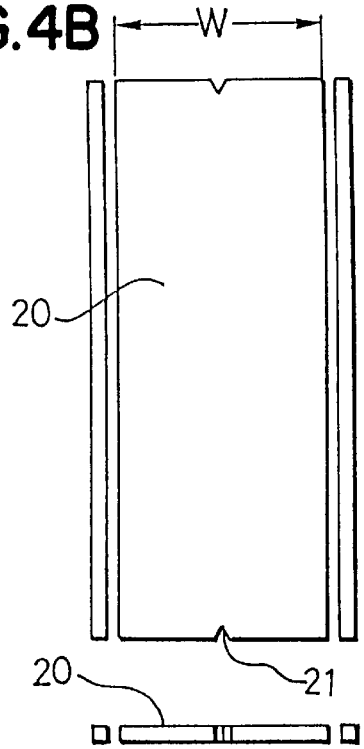
FIG. 4C
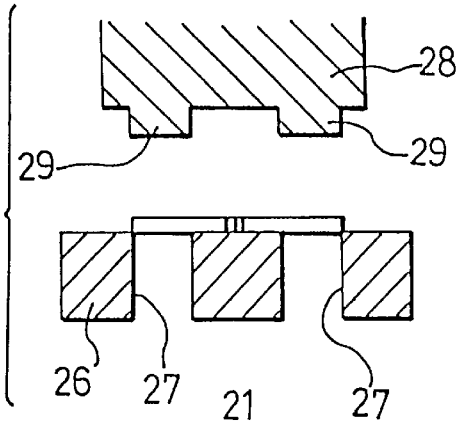
FIG. 5A
FIG. 5B
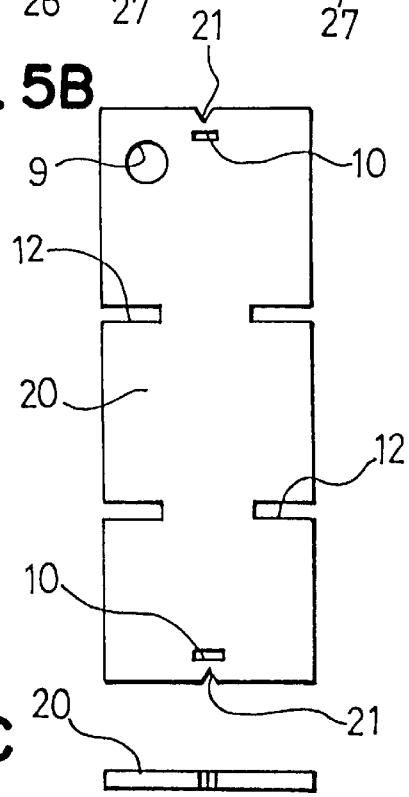
FIG. 5C

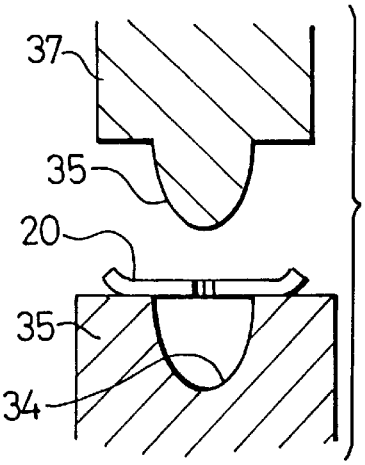
FIG. 8A
FIG. 8B
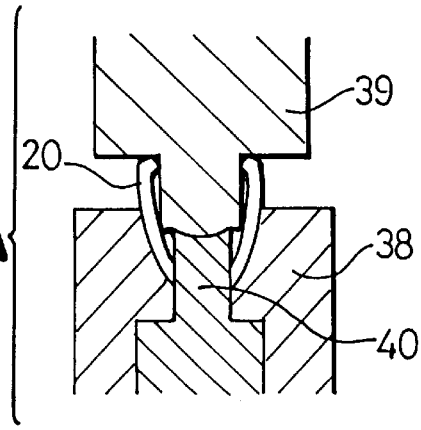
FIG. 9A
FIG. 9B
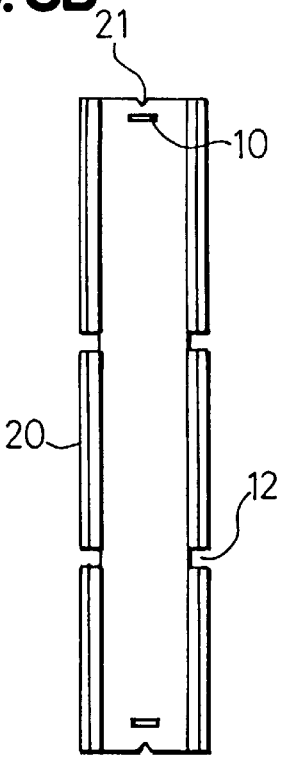
FIG. 8C
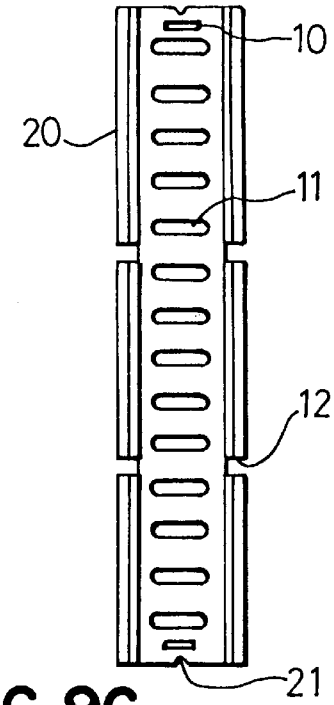
FIG. 9C
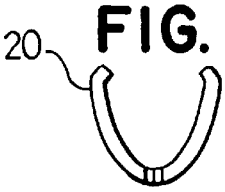
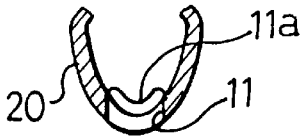

HEADER PIPE FOR HEAT EXCHANGER AND MANUFACTURING APPARATUS AND MANUFACTURING METHOD THEREOF

BACKGROUND OF THE INVENTION

1. Field of the Invention

The present invention relates to a header pipe that is employed in a condenser for a heat exchanger, a serpentine-type evaporator and the like, and is formed by shaping a flat plate material in the shape of a circular tube. It also relates to an apparatus employed for manufacturing this header pipe.

2. Description of the Related Art

Header pipes in the prior art (i.e., the header pipe for a heat exchanger disclosed in Japanese Unexamined Patent Publication No. H7-178486, for instance) are manufactured to form a header tank in the shape of a circular tube. A raw material (brazing sheet) in the form of a flat plate is fed in its lengthwise direction with a specific pitch. Tube insertion holes are sequentially formed in the material, and the material is gradually rolled while it is being fed.

To describe the manufacturing processes for manufacturing this header pipe in a more specific manner, inclined surfaces are formed on both side edges before the brazing sheet is rolled. Insertion holes for inserting partitioning plates and coupling holes for linking the intake/outlet coupling are formed in the brazing sheet. The entire brazing sheet is bent to form a rough U-shape after bending both side edges of the brazing sheet slightly and the insertion holes for inserting tubes are formed in this state. The brazing sheet is then bent to form a tubular shape, and inclined surfaces at the two side edges are abutted. Also, he brazing sheet is cut to a specific length with a cutter to form a header pipe.

With the header pipe described above, the inclined surfaces are provided at the two side edges of the brazing sheet in order to seal the pipe, and an ample bonding margin is obtained from using the inclined surfaces. However, level misalignment will occur at the abutted area if a force is applied in a direction in which the two inclined surfaces are abutted. In addition, because of the inclined surfaces, it is necessary to first roll one of the side edge portions of the brazing sheet and then to roll the other side edge portion in a final process in order to form a tubular header pipe. It has been learned through experience that this type of sequential bending results in level misalignment between the two side edge portions.

One possible solution is to provide a mandrel to ensure that no misalignment can occur in the abutted area. However, it is obvious that providing a mandrel will necessitate the use of larger dies, and will result in an increase in facilities cost. Development of a header tank and an apparatus for manufacturing the header tank that can solve this problem of misalignment in the abutted area without having to use a mandrel is desirable.

In the prior art, defective brazing is prevented by securing a sufficient brazing margin by providing the inclined surfaces on the side edge portions. It is necessary in developing a header pipe, such as described above, to give full consideration as to how the header pipe should be structured in order to assure reliable brazing.

SUMMARY OF THE INVENTION

Accordingly, an object of the present invention is to provide a header pipe and an apparatus for manufacturing this header pipe in which level misalignment of side edge portions that face opposite each other is prevented when a flat plate raw material is rolled to form a header pipe in the shape of a circular tube and also in which brazing defects can be eliminated. Another object of the present invention is to achieve miniaturization of the manufacturing apparatus and a reduction in facilities cost.

In order to achieve the objects described above, a header pipe for a heat exchanger according to the present invention is achieved by rolling a flat plate material into the shape of a circular tube so that surfaces at the two side edges extending in a lengthwise direction of the plate material are perpendicular to the internal and the external surfaces thereof The plate material is rolled so that the two side edges face opposite each other. A piping insertion hole is formed for inserting and bonding piping, and tube insertion holes are formed for inserting and bonding tubes in the plate material. The two side edges facing opposite each other do not contact each other.

With such a header pipe since the surfaces extending perpendicular to the internal and external surfaces are formed at the two side edges extending in the lengthwise direction, no level misalignment occurs with the two side edges coming into contact with each other even when the plate material is rolled through a pressing machine. Even if a force is applied in a direction in which the two side edges are abutted after the header pipe is formed, no level misalignment will occur. Furthermore, since the two side edge portions can be rolled at the same time rather than sequentially, it is not necessary to provide a mandrel in order to prevent level misalignment from occurring during the rolling process.

In addition, it is desirable that the side edges, which face opposite each other in the header pipe in a non-contact state, be separated by 0.3 mm or less. With this, defective brazing can be eliminated by assuring that flux penetrates into the area between the two side edges. In other words, good brazing is achieved by maintaining the two side edges in a non-contact state with a gap as disclosed in the present invention. If the gap between the side edges is too small, the flux will not penetrate into the gap resulting in defective brazing. If the gap is larger than 0.3 mm, the yield of the brazing material after brazing will be poor, and result in a reduction in strength which, in turn, may result in leakage of the heat exchanging medium caused by damage in the brazed area.

Alternatively, the header pipe may be made by forming the piping insertion hole after the plate material has been rolled so that the piping insertion hole has a cylindrical shape. A plurality of tube insertion holes are formed in the lengthwise direction in the plate material. Side plate supporting portions that support side plates are formed further outside relative to the plurality of tube insertion holes. The side plate supporting portions are formed by pressing on the side plate supporting portions.

If the piping insertion hole is formed before the plate material is rolled, the piping insertion hole will taper towards the internal surface (i.e., the hole will have a conical section) after the plate material is rolled, which makes it difficult to insert the piping. In contrast, according to the present invention, the piping insertion hole is formed when the plate material has already been rolled so that it will achieve a cylindrical shape, which eliminates this problem. In addition, the supporting portions for supporting the side plates are formed at the header pipe by pressing on the supporting portions. Mounting of the side plates to the header pipe is facilitated by the pressing, and at the same time, the side plates can be reliably supported at the header pipe.

An apparatus for manufacturing a header pipe with a circular tube shape by rolling a flat plate material may comprise a machining element that cuts the material to a specific length in the lengthwise direction to create a work piece of plate material. The apparatus may include a machining element that forms a width of the plate material that has been prepared by cutting in the direction of its short side to a specific dimension and trims the two side edge portions of the plate material so that cut surfaces perpendicular to the front and rear surfaces of the plate material are formed. Further, the apparatus may include a machining element that forms a piping insertion hole for inserting and bonding piping in the plate material that has been trimmed. Also, the apparatus may include a machining element that rolls the entirety of the plate material with the piping insertion hole formed in such a manner that the shape of a cross section perpendicular to the lengthwise direction will form a rough U-shape. The apparatus may include a machining element that forms a plurality of tube insertion holes for inserting and bonding tubes in the plate material that has been rolled. Further, the apparatus may include a machining element that rolls the two side edges of the plate material with the tube insertion holes formed to achieve a circular tube shape in such a manner that the two side edges face opposite each other with only an upper die and a lower die, while ensuring that the two side edges are set in a non-contact state.

To be more specific, the manufacturing apparatus may comprise a plurality of separate dies. The apparatus may include a die that cuts the material to a specific length in the lengthwise direction. The apparatus may also include a trimming die that trims the width of the cut plate material in the direction of its short side and also trims the two side edge portions at a right angle with respect to the front and rear surfaces of the plate material. Further, the apparatus may include a piping insertion hole forming die that forms the piping insertion hole for inserting and bonding piping in the plate material that has been trimmed. The apparatus may include an arc bending die that rolls the entirety of the plate material so that the shape of a cross section perpendicular to the lengthwise direction forms a rough U-shape. Further, the apparatus may include a tube insertion hole forming die that forms the plurality of tube insertion holes for inserting and bonding tubes. Also, the apparatus may include a roll bending die that clamps the plate material with the tube insertion holes formed only with upper and lower dies without requiring a mandrel, to form the entirety of the plate material into a circular tube shape so that the two side edges of the plate material maintain a non-contact state after the rolling is completed.

Thus, by employing such a manufacturing apparatus, the material is cut by the cutting die to match the length of the header pipe. A specific width is achieved through trimming. The cut surfaces are formed at a right angle with respect to the front and rear surfaces by the trimming die. After this, the piping insertion hole is formed by the piping insertion hole forming die. The plate material is partially bent by the arc bending die so that it bends in the direction of its short side. In this bent state, the tube insertion holes are formed in the plate material by the tube insertion hole forming die. Then, by employing the roll bending die, the plate material is clamped only by the upper and lower dies to form the entire plate material into a circular tube shape so that the area between the cut surfaces (the area between the two side edges) maintains a non-contact state after the formation to complete the manufacturing process for the header pipe. This gap between the two side edges is set equal to or less than 0.3 mm through pressing by anticipating spring-back in the plate material. This gap is achieved by adjusting the width of the plate material, the distance between the upper and lower dies at the time of pressing, and the plate thickness. Since the gap between the two side edges is normally formed wider toward the two ends in the lengthwise direction compared to the central area, it is also necessary to adjust the length of the gap in anticipation of this.

In addition, when cutting the raw material in the lengthwise direction, it is desirable to also form a notch for positioning along the cut edge of the material. The notch is necessary to position the plate material at specific positions during the individual processes in automated pressing. It is also necessary to set the header pipe in a specific direction when automatically assembling the formed header pipe with piping (tubes and the like). A characteristic shape that can be automatically recognized by the manufacturing apparatus and the assembly apparatus is formed in the plate material by providing the notch as described above, and makes it possible to satisfy the positioning-related requirements for an automated system.

Furthermore, it is desirable to form the piping insertion hole in the plate material by pressing before bending the plate material so that the piping insertion hole achieves a cylindrical shape when the plate material is rolled in order to facilitate the insertion of the piping. This pressing prevents the piping insertion hole from becoming narrowed down to a diameter smaller than that of the piping when the plate material is rolled, and ensures that the piping can be inserted smoothly.

To summarize the advantages, based upon the explanation given above:

① When forming the circular tube-shaped header pipe by rolling the flat plate material, since the side edges of the plate material that face opposite each other are formed as surfaces extending at a right angle with respect to the internal and external surfaces, a level misalignment of the side edge portions facing opposite each other is prevented. The two side edges can be rolled at the same time during the rolling process of the plate material, which eliminates any likelihood of a level misalignment occurring and also makes it unnecessary to use a mandrel in order to avoid a level misalignment. As a result, since the mandrel can be dispensed with, the header pipe manufacturing apparatus can be miniaturized and a reduction in facilities cost can be achieved.

Furthermore, since the side edges of the header pipe are kept in a non-contact state with the distance between them set at 0.3 mm or less, flux can thoroughly penetrate into the area between the side edges, and thereby assure good brazing.

② By forming the piping insertion hole of the header pipe so that it achieves a cylindrical shape when the plate material is rolled and by pressing on the side plate supporting portions, the piping and the side plates can be mounted at the header pipe with ease and with a high degree of reliability.

③ Since the raw material is made into a work piece of plate material by cutting it to a specific length in the lengthwise direction, surfaces that are at right angles with respect to the front and rear surfaces of the plate material are formed when trimming the width of the plate material that has been cut in the direction of its short side to a specific dimension. The entirety of the plate material is rolled so that the shape of a cross section perpendicular to its lengthwise direction forms a rough U-shape after the piping insertion hole is formed in the trimmed plate material. The plurality of tube insertion holes for inserting and bonding tubes are formed in the plate material that has been rolled. The two side edges of the plate material with the tube insertion holes formed are rolled only with the upper and lower dies to form a circular tube shape so that they face opposite each other while ensuring that the two side edges are set in a non-contact state with the gap between them at or less than 0.3 mm. A header pipe without any level misalignment between the side edge portions can be formed without using a mandrel. Furthermore, good brazing in the area between the two side edge portions facing opposite each other is assured.

④ In particular, by forming notches for positioning concurrently with cutting the raw material in the lengthwise direction, it becomes possible to perform positioning by using this notch when automatically positioning the plate material at specific positions during the manufacturing processes of the header pipe and when automatically assembling the formed header pipe with piping (tubes and the like).

⑤ By implementing pressing at the piping insertion hole before rolling the plate material, the piping insertion hole is formed in a cylindrical shape to correspond to the diameter of the piping when the plate material is rolled, and thereby ensure that the piping can be inserted reliably and smoothly.

BRIEF DESCRIPTION OF THE DRAWINGS

The above and other features of the invention and the concomitant advantages wMl be better understood and appreciated by persons skilled in the field to which the invention pertains in view of the following description given in conjunction with the accompanying drawings which illustrate a preferred embodiment. In the drawings:

FIGS. 4A, 4B, and 4C illustrate a process performned at step 62 in FIG. 2;

FIGS. 5A, 5B and 5C illustrate a process performed at step 64 in FIG. 2;

FIGS. 8A, 8B and 8C illustrate a process performed at step 70 in FIG. 2;

FIGS. 9A, 9B and 9C illustrate a process performed at step 72 in FIG. 2;

DETAILED DESCRIPTION OF THE PREFERRED EMBODIMENT

The following is an explanation of an embodiment of the present invention with reference to the drawings.

Figure 1:
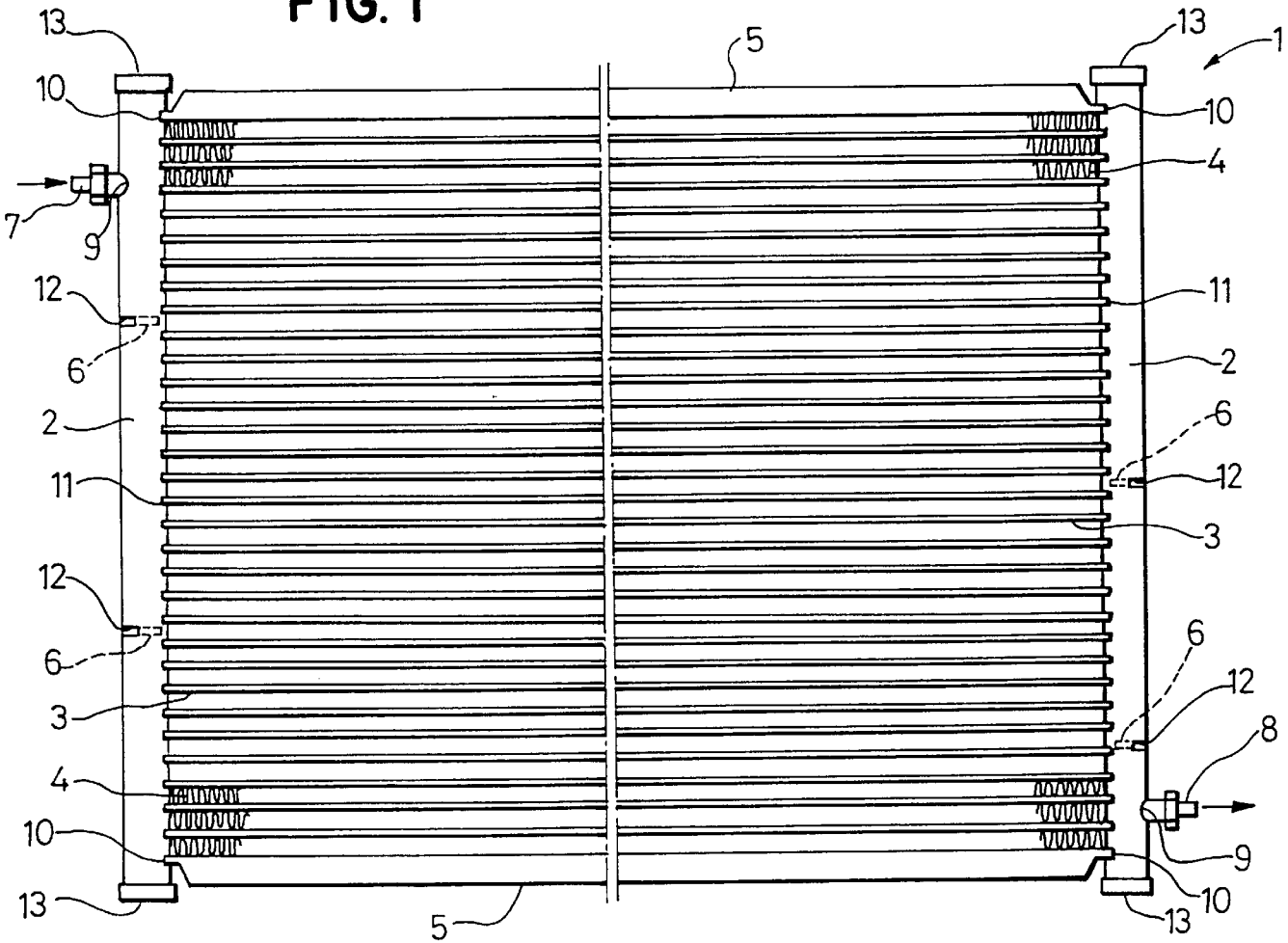
FIG. 1 shows a heat exchanger (condenser) that employs a header pipe according to the present invention.

FIG. 1 shows a condenser 1 that may be mounted in, for instance, a vehicle. The condenser 1 is provided with a pair of header pipes 2. A plurality of tubes 3 that are bonded between the header pipes 2 communicate between one header pipe and the other header pipe. The tubes 3 are laminated with fins 4 over a plurality of levels with equal pitch. Toward the outside of the laminated tubes 3, side plates 5 whose cross sections form U-bracket shapes are bonded between the pair of header pipes 2. In each header pipe 2, partitioning walls 6 which divide the internal space are provided. At one of the header pipes, an intake piping 7 through which heat exchanging medium flows into the condenser is bonded. At the other header pipe an outlet piping 8 through which the heat exchanging medium flows out is bonded. The heat exchanging medium that flows into one of the header pipes via the intake piping 7 passes between the header pipes 2 a plurality of times while sequentially flowing through different tube groups to reach the outlet piping 8 of the other header pipe. During the process in which the heat exchanging medium makes a plurality of passes, heat exchanging is performed with the air passing between the fins 4.

The header pipes 2, which are formed by shaping a plate material into a circular tube form (as discussed later), are each provided with a piping insertion hole 9 for inserting and bonding the intake piping 7 or the outlet piping 8, side plate supporting holes 10, and a plurality of tube insertion holes 11. The side plate supporting holes 10 are used for receiving and bonding projecting pieces 5*a* (shown in FIG. 14A) formed at the end portions of the side plates 5 in a lengthwise direction. The plurality of tube insertion holes 11 are used for receiving and bonding the tubes 3. In addition, partitioning wall insertion slits 12 are formed at specific positions for mounting the partitioning walls 6. The two open ends of each header pipe 2 are blocked by blocking members 13.

Figure 15:
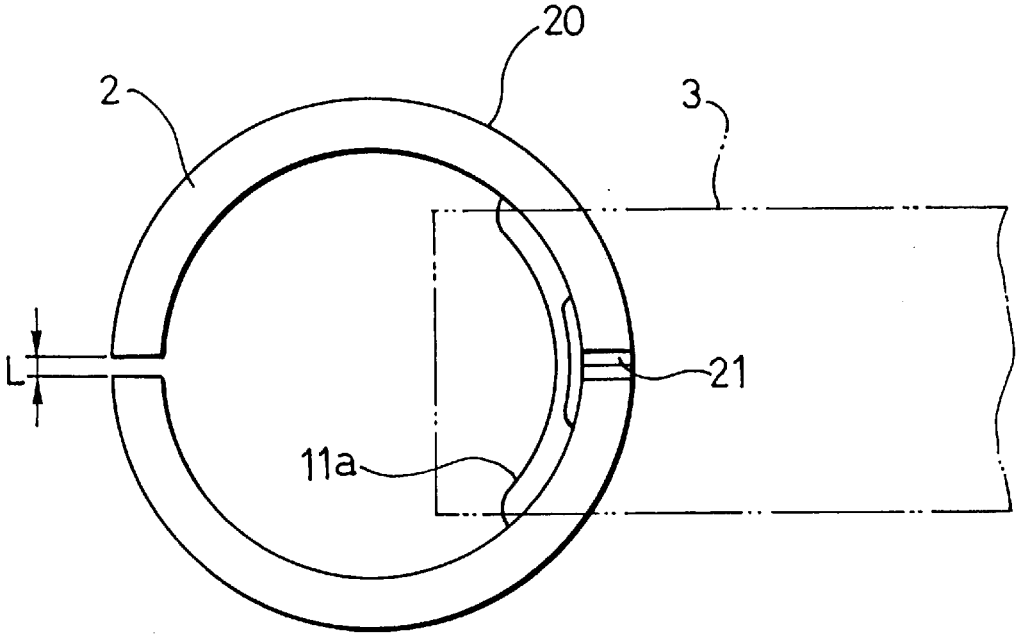
FIG. 15 is an enlargement of the header pipe viewed from one end in a lengthwise direction.
Figure 16:
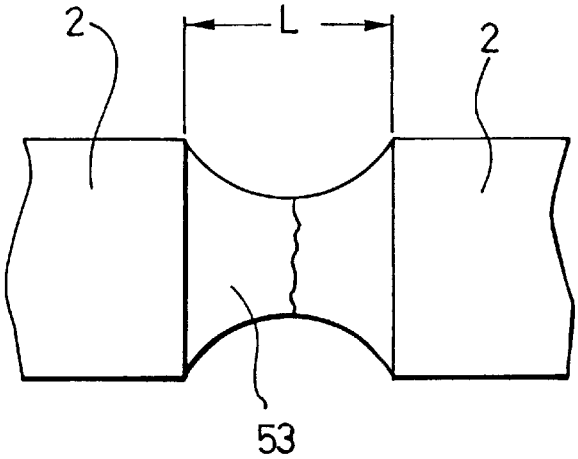
FIG. 16 illustrates a state in which the side edges of the header pipe facing opposite each other are brazed.

The condenser 1 is completed by brazing the header pipes 2, the tubes 3, the fins 4, the side plates 5, the partitioning walls 6, the pipings 7 and 8, and the blocking members 13 all together. When a single header pipe is viewed, as shown in FIG. 15, the two side edges of the rolled plate material 20 face opposite each other over a specific distance L. These side edges facing opposite each other form cut surfaces that extend at right angles with respect to the internal and external surfaces of the header pipe 2.

Figure 13:
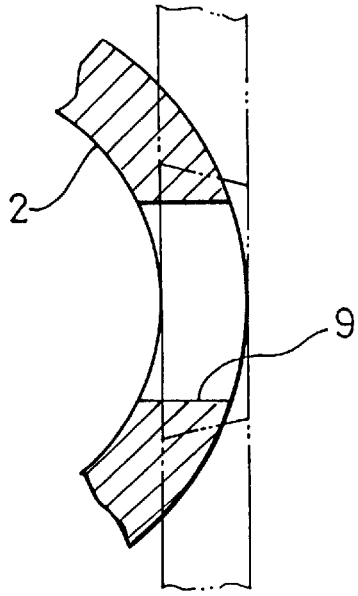
FIG. 13 is a cross section showing a piping insertion hole in a plate material, with a solid line indicating a state in which the plate material is rolled and a two-point chain line indicating a state before rolling the plate material.
Figure 14A:
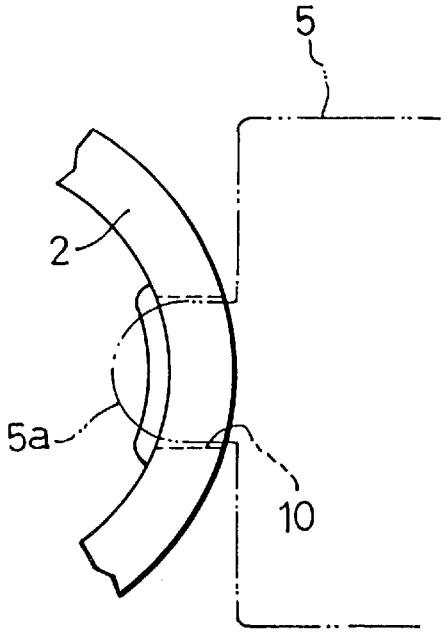
FIG. 14A shows when projecting pieces of side plates are inserted in side plate supporting holes.
Figure 14B:
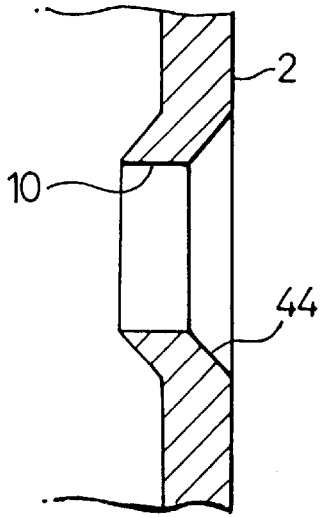
FIG. 14B shows a cross section of the side plate supporting holes.

In addition, the piping insertion hole 9 for bonding the intake piping 7 or the outlet piping 8 is formed in a cylindrical shape extending from the external surface to the internal surface of the header pipe 2 (as indicated by the solid line in FIG. 13). Pressing of the side plate supporting holes 10 is implemented from the external surface (as shown in FIG. 14B).

Figure 2:
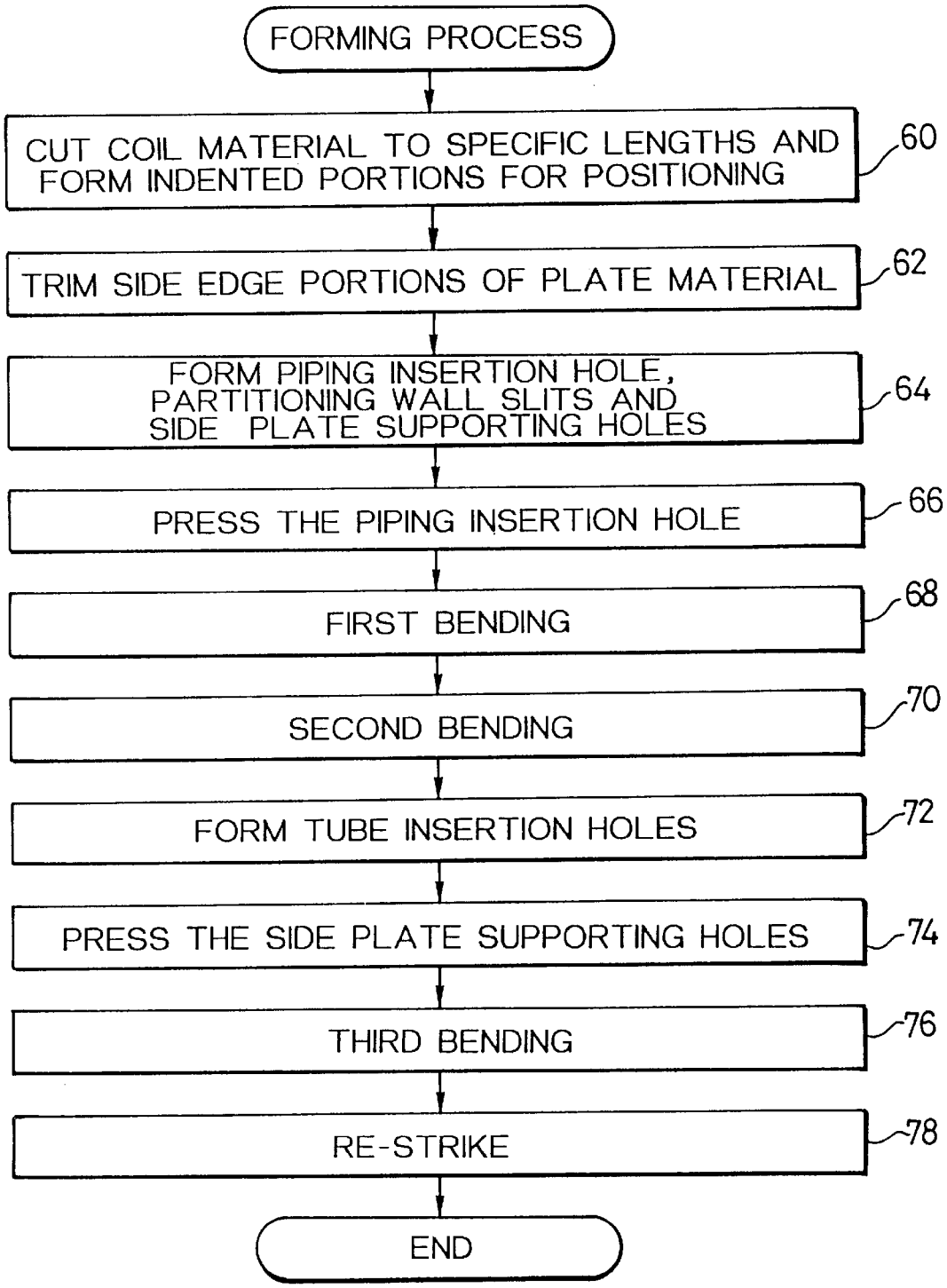
FIG. 2 is a flowchart illustrating a manufacturing processes for the header pipe.
Figure 3:
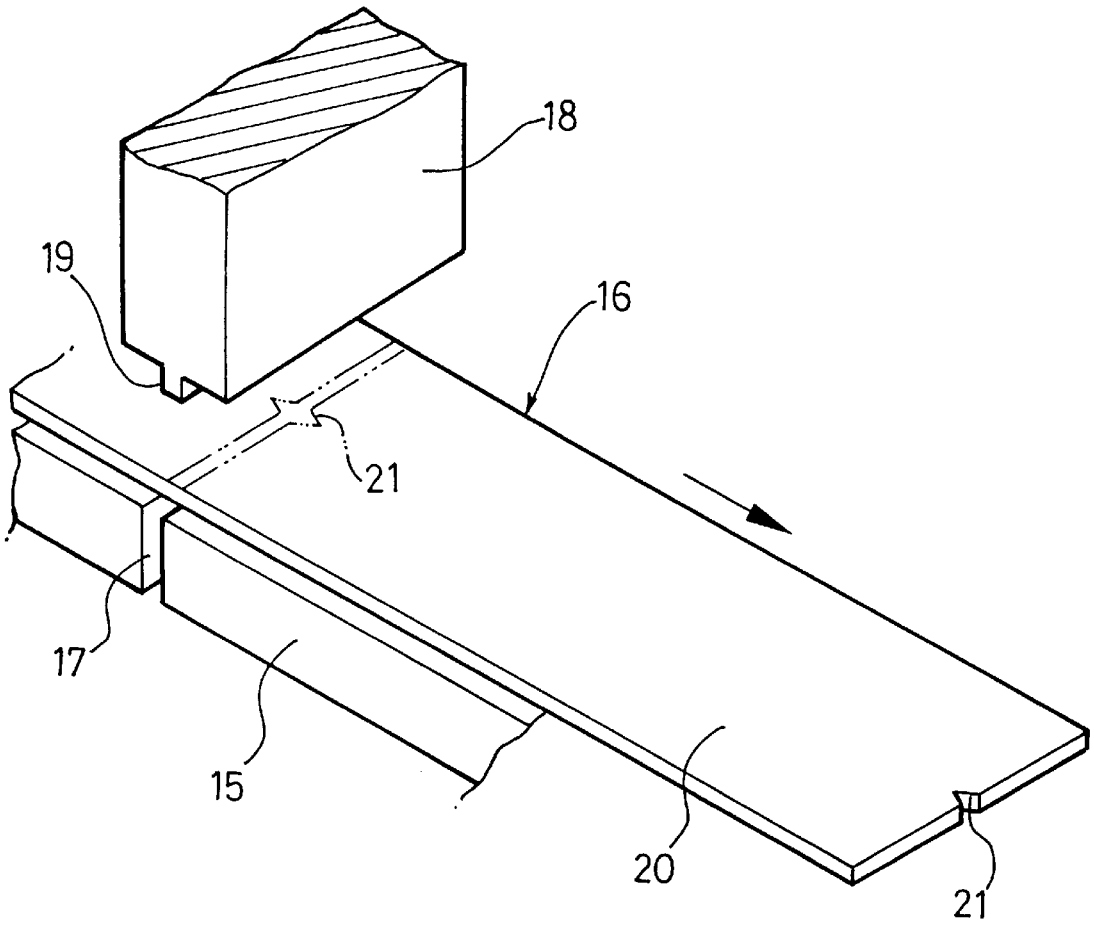
FIG. 3 illustrates a process performed at step 60 in FIG. 2.

These processes for forming the header pipe 2 are achieved through a series of processing steps presented in FIG. 2. First, coiled raw material 16, made of an aluminum alloy that is wound in a coil and has a specific plate thickness, is cut to a specific length (step 60). Specifically, in this cutting process, the coiled material 16 is sheared by an upper die 18 and a lower die 15 to create a plate material 20 with a specific length. The lower die 15 has a slit 17 extending at a right angle with respect to the direction in which the coiled material 16 is fed. The upper die 18 has a projecting punch portion 19 that fits into the slit 17 of the lower die 15 with a specific clearance (as shown in FIG. 3). In addition, during this process, an indented portion for positioning 21 is also formed at the center of the sheared surface of the plate material 20. This indented portion for positioning 21 may be formed at the two ends in the lengthwise direction of the plate material 20 in the shape of, for instance, a wedge (a V-shape).

The plate material 20 that has been cut to a specific length is turned 90° so that it advances in the direction of its short side instead of the lengthwise direction. Then its side edge portions are trimmed (step 62). During this trimming process, machining must be performed with a high degree of accuracy, since the width W of the plate material 20 affects gap L between the side edges after the header pipe 2 is formed. As shown in FIGS. 4A–4C, a pair of slits 23 formed in a lower die 22 extend in the lengthwise direction of the plate material 22 and a pair of projecting punch portions 25, which fit into the slits 23, are formed in an upper die 24. Both surface side edge portions are cut perpendicular to the front and rear surfaces in such a manner that the width W of the plate material 20 achieves a specific width which has been set in advance through adjustment.

Next, the piping insertion hole 9, the partitioning wall slits 12 and the side plate supporting holes 10 are formed in the trimmed plate material 20 (step 64). A die hole (not shown) for forming the piping insertion hole 9, slits 27 for forming the partitioning wall slits 12 and die holes (not shown) for forming the side plate supporting holes 10 are provided in a lower die 26 which is employed during this process. In an upper die 28, punch portions (not shown) to be fitted into the die holes and punch portions 29 to be fitted into the slits 27 are provided. The upper die 28 and the lower die 26 are provided so that the piping insertion hole 9, the partitioning wall slits 12 and the side plate supporting holes 10 are punched in the plate material 20 at the same time (see FIGS. 5A–5C).

Figure 6A:
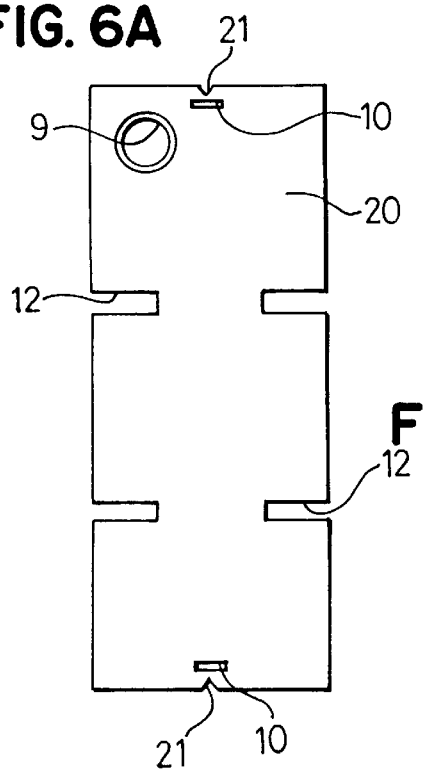
FIGS. 6A and 6B illustrate a process performned at step 66 in FIG. 2.
Figure 6B:
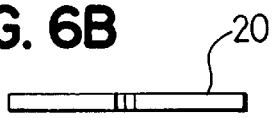

Then, in the following step 66, pressing of the piping insertion hole 9 is performed (see FIGS. 6A–6B). This pressing is performed to form a circumferential edge of a hole into the shape of a conical section so that it gradually becomes narrower from the side that forms the internal surface of the header pipe toward the side that forms the external side, and to ensure that the piping insertion hole 9 achieves a cylindrical shape from the external surface toward the internal surface when the plate material is rolled later.

Figure 7A:
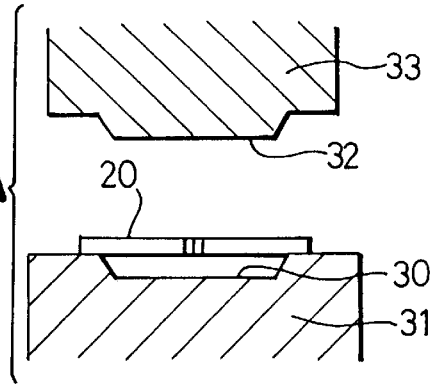
FIGS. 7A, 7B and 7C illustrate a process performed at step 68 in FIG. 2.
Figure 7B:
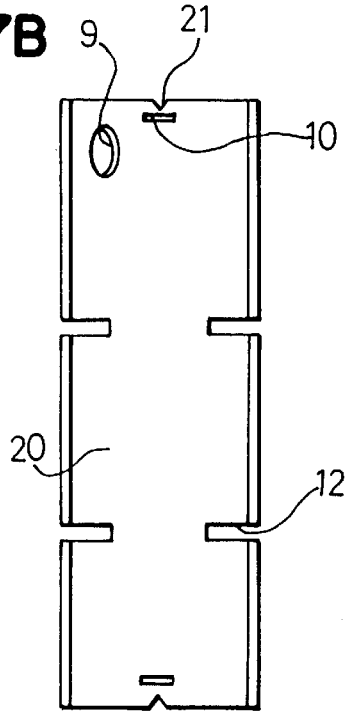
Figure 7C:
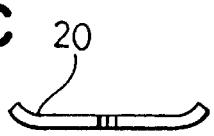

When the processes described above are completed, a process for rolling the plate material 20 is performed in the following steps (steps 68–78). First, a first bending process is implemented (step 68). As shown in FIGS. 7A–7C, a die portion 30 with a shallow indentation is provided in a lower die 31 and a die portion 32 that distends to correspond to the indented die portion 30 is provided in an upper die 33. By pressing the plate material 20 with the upper and lower dies, the two side edge portions of the plate material 20 are slightly bent.

Next, a second bending process is implemented (step 70). In this process, as shown in FIGS. 8A–8C, an indented portion 34 whose cross section has a semi-spherical shape is provided in a lower die 35 and a projected portion 36 whose cross section is a semispherical shape to correspond to that of the indented portion 34 is formed in an upper die 37. The plate material 20 is pressed with the upper 37 and lower 35 dies so that the entirety of the plate material 20 is roughly bent in the direction of its short side so that the two side edges approach each other and the cross section is formed into a U-shape.

In the plate material 20 that has been roughly bent in this manner, tube insertion holes 11 for inserting and bonding tubes 3 are formed in the next process (step 72). The plurality of tube insertion holes 11 are formed all at once or in groups of a specific number with a punch 40 that projects out upward from a lower die 38 while the plate material 20 is held by an upper die 39 and the lower die 38, as shown in FIGS. 9A–9C. As shown in FIG. 15, burrs 11*a* are formed on the circumferential edges of the tube insertion holes 11 formed by the punch 40.

Figure 10A:
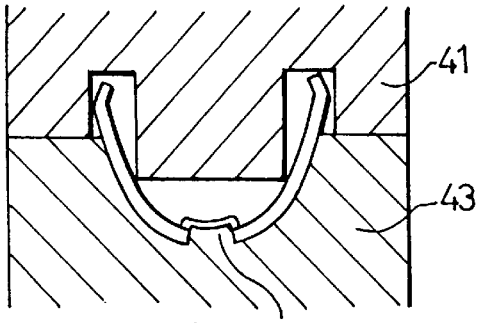
FIGS. 10A, 10B and 10C illustrate a process performed at step 74 in FIG. 2.
Figure 10B:
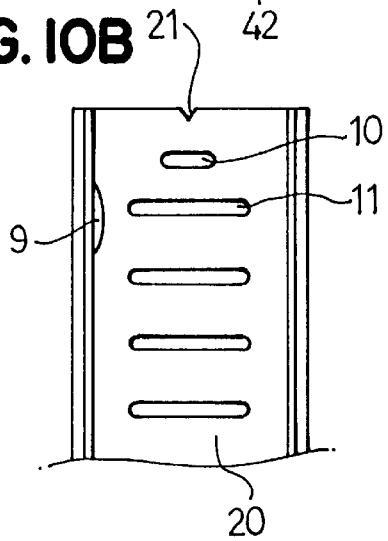
Figure 10C:
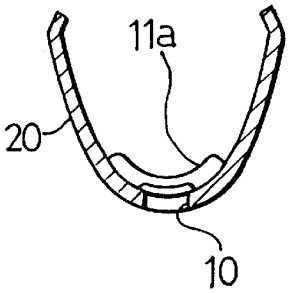

Next, in step 74, pressing of the side plate supporting holes 10 is performed. This pressing is performed on the plate material 20 that has been bent halfway by an upper die 41 that presses it from above and a lower die 43 that is provided with a projected portion 42 for pressing the circumferential edges of the side plate supporting holes of the plate material 20, as shown in FIGS. 10A–10C. As a result, each side plate supporting hole 10 will have a conical section 44 formed on the external surface that will facilitate guiding a projecting piece 5*a* of the side plate 5 into the side plate supporting hole 10 while the side plate supporting holes 10 will project some distance toward the inside of the header pipe 2, as shown in FIG. 14A and FIG. 14B.

Figure 11A:
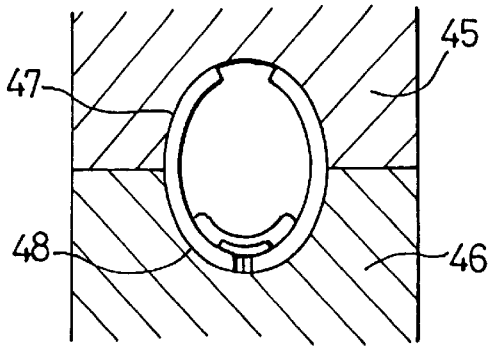
FIGS. 11A, 11B and 11C illustrate a process performed at step 76 in FIG. 2.
Figure 11B:
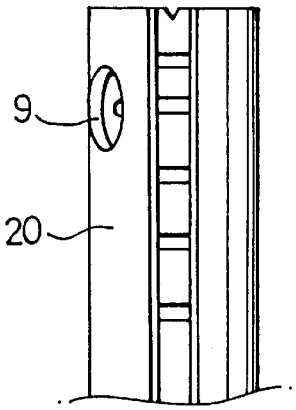
Figure 11C:
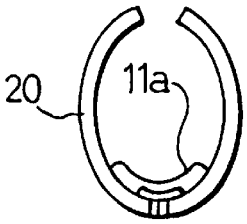

After the pressing of the side plate supporting holes 10 is completed, a third bending process is implemented (step 76). In this process, as shown in FIGS. 11A–11C, indented portions 47 and 48 with semi-circular cross sections are provided in an upper die 45 and a lower die 46 respectively. The plate material 20 is formed into a roughly cylindrical shape by pressing the plate material 20 with the upper die 45 and the lower die 46 to roll it so that the side edges approach each other to achieve an elongated oval shape for the cross section.

Figure 12A:
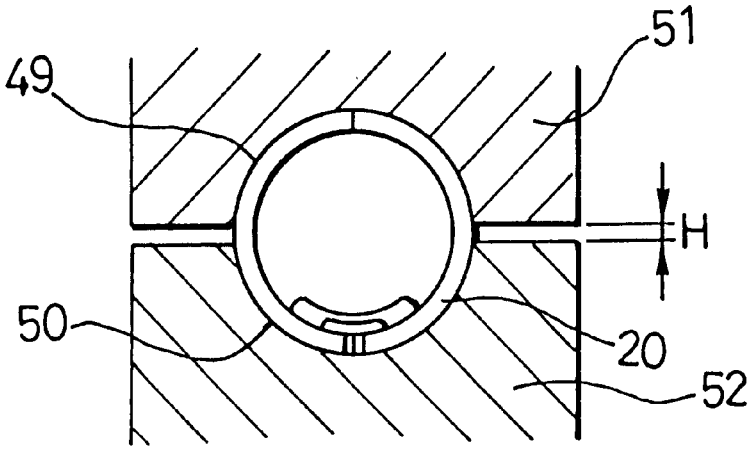
FIGS. 12A, 12B and 12C illustrate a process performed at step 78 in FIG. 2.
Figure 12B:
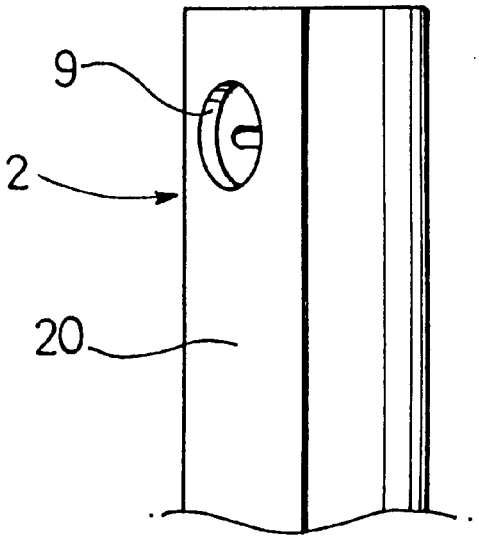
Figure 12C:
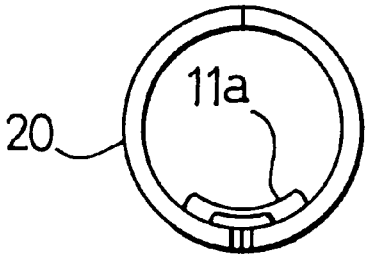

Lastly, re-striking is performed in a fourth bending process (step 78). In this process, as shown in FIGS. 12A–12C, semi-circular indented portions 49 and 50 which correspond to the final shape of the header pipe 2 are provided in an upper die 51 and a lower die 52 respectively. The plate material 20 is press-formed to achieve the ultimate cylindrical shape by the upper die 51 and the lower die 52. The distance traveled between the upper and lower dies (i.e., the distance H between the upper 51 and lower 52 dies during the pressing process), the width W of the plate material mentioned earlier, the plate thickness and the like are determined in advance to ensure that the distance L between the side edges of the finished header pipe 2 will maintain a non-contact state with the distance L at 0.3 mm or less with consideration of spring-back in the plate material 20.

Figure 17:
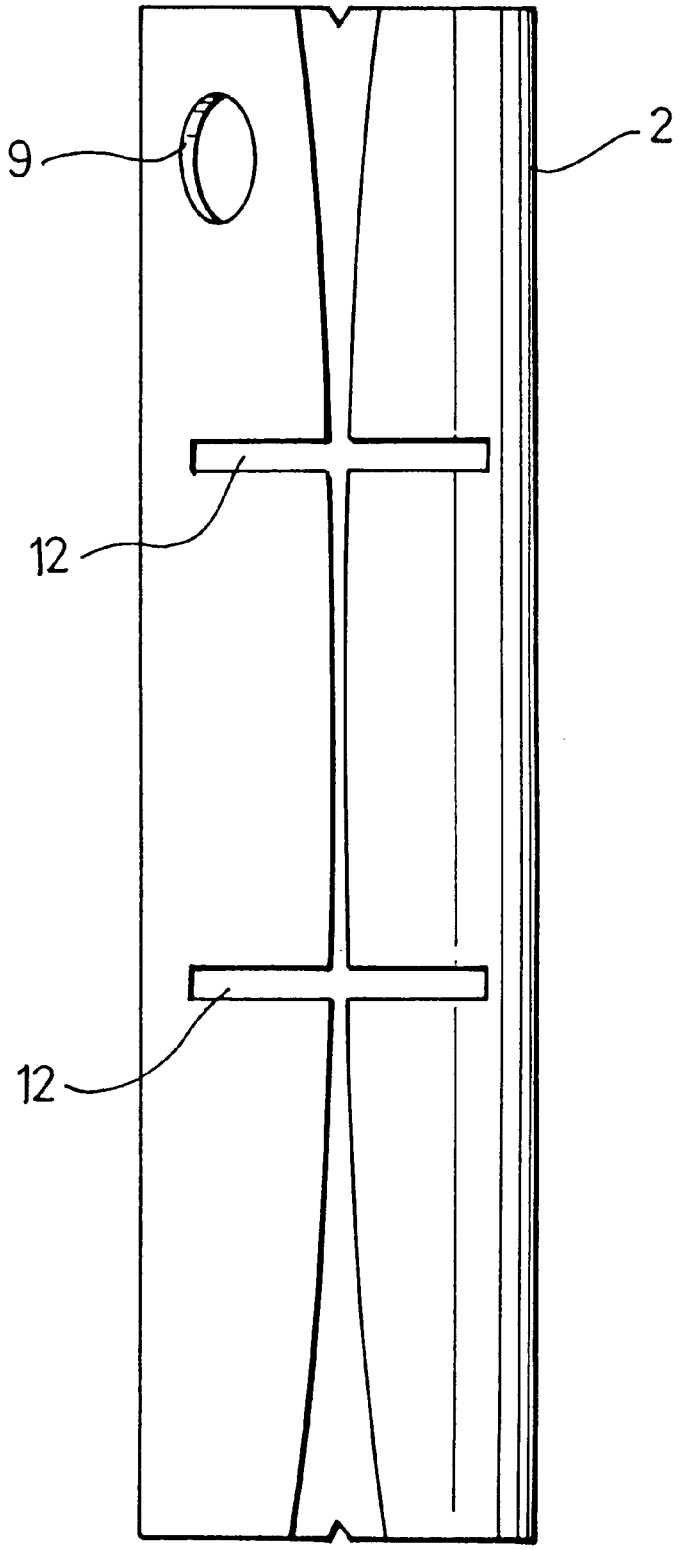
FIG. 17 illustrates a manufactured header pipe with a gap formed between the two side edges shown in an exaggerated manner.

The side edges of the header pipe 2 are set in a non-contact state with the distance between them at or less than 0.3 mm in this manner, because if there is no gap between the side edges, there will be no space into which flux can flow, and therefore, no brazing will be accomplished in that area. Through experience it has been learned that with a header pipe manufactured through the processes described above, even when the gap is at approximately 0.01 mm, flux will penetrate into the gap to achieve good brazing. This is assumed to be attributable to the shape of the gap between the two side edges, which gradually widens toward the two ends of the header pipe in the lengthwise direction achieving an overall wedge shape. The wedge shape allows flux to flow in from the periphery even with the gap at the central area being very small at approximately 0.01 mm as illustrated in detail in FIG. 17 (which shows the gap in an exaggerated manner).

In addition, the upper limit of the distance between the side edges is set at 0.3 mm. Although the flux and brazing material will enter the gap easily if the gap L is larger than 0.3 mm, the brazing material 53 at the joint between the side edges of the header pipe 2 will be spread thinner than the plate thickness. This results in weakness and probable damage in this area, which in turn is likely to result in a leak of heat exchanging medium.

It is to be noted that the dies employed in the individual processes are made in large sizes so that they can support changes in the length of the plate material. The manufacturing apparatus automatically positions the plate material 20 at specific positions with respect to the individual dies using the indented portions for positioning 21 formed in the plate material 20 as reference points.

As a result, in the header pipe 2 formed in the manner described above, since the side edges that face opposite each other are cut at a right angles to the internal and external surfaces, no level misalignment will occur between the side edge portions even when a force is applied in the direction in which the two side edges are abutted during press forming or after the formation of the header pipe. Furthermore, since the side edges are formed at right angles to the internal and external surfaces, the two side edges can be rolled at the same time, eliminating any time lag between the processes in which the plate material 20 is rolled and in particular during the final process. Thus, a force is applied to the two side edges in a symmetrical manner during pressing to achieve consistent rolling. In other words, any level misalignment that might otherwise occur during the rolling processes is avoided, which in turn, eliminates the necessity for placing a mandrel inside the plate material 20 during press-forming in anticipation of such a misalignment. This makes it possible to form the header pipe 2 into a desired shape entirely through pressing performed by upper and lower dies. In addition, since the side edge portions of the formed header pipe 2 face opposite each other over a gap equal to or less than 0.3 mm good penetration of flux is assured, thereby eliminating the problem of defective brazing.

Moreover, if no pressing is performed while forming the piping insertion hole 9 in the plate material 20, there will be a problem in that when the plate material is rolled, the internal diameter of the piping insertion hole 9 will be smaller than its external diameter and the piping 7 or 8 cannot be inserted when assembling the condenser 1. Therefore, with the pressing performed in advance as in the present invention, the insertion of the pipings 7 and 8 will be facilitated which assures reliable assembly and brazing.

Furthermore, since the side plate supporting holes 10 are pressed in the header pipe 2 as described above, it is not necessary to position the projecting pieces 5*a* at the supporting holes 10 with a high degree of accuracy during assembly of the side plates 5. As long as the projecting pieces 5*a* are placed at the surface of the header pipe 2 within an approximate range over which the conical section 44 is formed, the projecting pieces 5*a* will be guided by the conical section 44 to be inserted into the holding hole 10 which improves the efficiency in the assembly.

What is claimed is:

1. A header pipe for a heat exchanger, comprising:

a longitudinally elongated circular tube formed of a plate material, said circular tube having two open ends, an interior, and two longitudinally extending side edges confronting each other in a non-contact state without level misalignment;

wherein a piping insertion hole is formed in said circular tube to receive a pipe in fluid connection with said interior of said circular tube;

wherein a plurality of tube insertion holes are formed in said circular tube to receive a plurality of fin contacting tubes in fluid connection with said interior of said circular tube; and wherein a gap is formed between said two side edges, and said gap becomes gradually wider towards said two open ends in a lengthwise direction of said circular tube.

2. The header pipe for a heat exchanger according to claim 1, wherein said circular tube includes an internal surface and an external surface, said two side edges comprising surfaces extending at right angles with respect to said internal and external surfaces.

3. The header pipe for a heat exchanger according to claim 2, wherein said gap is set at or less than 0.3 mm.

4. The header pipe for a heat exchanger according to claim 2, wherein said piping insertion hole has a cylindrical shape.

5. The header pipe for a heat exchanger according to claim 2, wherein said plurality of tube insertion holes are spaced apart along said lengthwise direction of said circular tube, a side plate supporting portion is formed in said circular tube between said plurality of tube insertion holes and one of said two open ends, and said side plate supporting portion includes a tapered portion.

6. The header pipe for a heat exchanger according to claim 2, wherein said circular tube includes a first positioning notch formed at one of said two open ends of said circular tube, and a second positioning notch formed at the other of said two open ends of said circular tube.

7. The header pipe for a heat exchanger according to claim 2, wherein said plurality of piping insertion holes are formed so as not to encroach upon an area where said two side edges face opposite each other.

8. The header pipe for a heat exchanger according to claim 7, wherein a slit is formed in said circular tube to receive a partitioning wall such that the partitioning wall protrudes into said interior of said circular tube, and said slit encroaches upon said area where said two side edges face opposite each other.

9. The header pipe for a heat exchanger according to claim 1, wherein said gap is set at or less than 0.3 mm.

10. The header pipe for a heat exchanger according to claim 1, wherein said piping insertion hole has a cylindrical shape.

11. The header pipe for a heat exchanger according to claim 1, wherein said plurality of tube insertion holes are spaced apart along said lengthwise direction of said circular tube, a side plate supporting portion is formed in said circular tube between said plurality of tube insertion holes and one of said two open ends, and said side plate supporting portion includes a tapered portion.

12. The header pipe for a heat exchanger according to claim 1, wherein said circular tube includes a first positioning notch formed at one of said two open ends of said circular tube, and a second positioning notch formed at the other of said two open ends of said circular tube.

13. The header pipe for a heat exchanger according to claim 1, wherein said plurality of piping insertion holes are formed so as not to encroach upon an area where said two side edges face opposite each other.

14. The header pipe for a heat exchanger according to claim 13, wherein a slit is formed in said circular tube to receive a partitioning wall such that the partitioning wall protrudes into said interior of said circular tube, and said slit encroaches upon said area where said two side edges face opposite each other.

* * * * *